United States Patent [19]

Furutani et al.

[11] Patent Number: 4,544,462

[45] Date of Patent: Oct. 1, 1985

[54] PROCESS FOR REMOVING METAL SURFACE OXIDE

[75] Inventors: Yasumasa Furutani, Katsuta; Yasuo Hira, Hitachi; Takashi Hasegawa, Ibaraki; Akira Minato, Hitachi; Saburo Shoji, Hitachi; Osao Sumita, Hitachi, all of Japan

[73] Assignees: Hitachi, Ltd., Tokyo; Hitachi Engineering Co., Ltd., Hitachi, both of Japan

[21] Appl. No.: 620,335

[22] Filed: Jun. 13, 1984

[30] Foreign Application Priority Data

Jun. 13, 1983 [JP] Japan ..... 58-105446

[51] Int. Cl.[4] ..... C25B 1/04; C25F 1/06

[52] U.S. Cl. ..... 204/129; 204/141.5; 204/144; 204/145 R

[58] Field of Search ..... 204/141.5, 144, 145 R, 204/129

[56] References Cited

U.S. PATENT DOCUMENTS 1,511,967 10/1924 Holland ..... 204/144
3,666,667 5/1972 Wieczorek ..... 204/145 R
3,900,376 8/1975 Copsey et al. ..... 204/145 R
4,264,418 4/1981 Wood et al. ..... 204/145 R

FOREIGN PATENT DOCUMENTS 629239 7/1949 United Kingdom ..... 204/144

OTHER PUBLICATIONS

"The Galvanic Series" Hanson Van Winkle Mining Co., 1949.

*Primary Examiner*—R. L. Andrews
*Attorney, Agent, or Firm*—Beall Law Offices

[57] ABSTRACT

The present invention provides a process for removing a metal surface oxide from a metallic substance by contacting the metal surface oxide layer with a deterging liquid to introduce electrons into the metal surface oxide in contact with the deterging liquid to dissolve the metal surface oxide, which process is characterized in that a metal piece or carbon piece is immersed in the deterging liquid into which gaseous hydrogen has been introduced and the metal piece or carbon piece is electrically connected to the metal surface oxide on the metallic substance. The metal piece is preferably platinum or vanadium. A preferred deterging liquid is one having a pH of about 5 to 7 and containing a complexing agent.

11 Claims, 1 Drawing Figure

PROCESS FOR REMOVING METAL SURFACE OXIDE

BACKGROUND OF THE INVENTION

1. Field of the Invention

The present invention relates to a process for removing a metal surface oxide. More particularly, the invention relates to an improvement in or relating to a process for removing a metal surface oxide which comprises contacting a metallic substance to be deterged with a deterging liquid to introduce electrons into the oxide formed on the metal surface and to remove the oxide by dissolution.

2. Prior Art

Oxides adhere to or grow on inner metal surfaces of apparatuses and piping in thermoelectric power plants, nuclear power plants and chemical plants. Particularly, in the nuclear power plants, radioactive ions contained in a cooling water are incorporated in the oxides.

The inventors proposed previously a process for removing oxides formed on the metal surface (surface oxide).

This previous process comprises contacting a metallic substance to be deterged such as an apparatus or piping with a substantially neutral deterging liquid to introduce electrons into a metal surface oxide layer by an external energy as disclosed in the specification of Japanese Patent Laid-Open No. 85980/1982.

To further improve this process, the inventors attempted to employ hydrogen as a chemical species used for introducing the electrons and to introduce the electrons formed by the following reaction:

$$H_2 \rightarrow 2H^+ + 2e^-$$

into a metal surface oxide layer. However, when hydrogen was used alone, the introduction rate of the electrons was insufficient for increasing the dissolution rate of the metal surface oxide significantly.

SUMMARY OF THE INVENTION

An object of the present invention is to provide a process for rapidly dissolving and removing a metal surface oxide formed on the surface of a metal substance to be deterged.

Another object of the invention is to provide a process for removing a metal surface oxide from a metallic substance by introducing electrons efficiently to accelerate the dissolution of the metal surface oxide.

The present invention relates to a process for removing a metal surface oxide by introducing electrons therein to dissolve the metal surface oxide, wherein a deterging liquid containing gaseous hydrogen is used, a metal piece or carbon piece is immersed in the deterging liquid and the metal surface oxide is connected with the metal piece or carbon piece electrically.

According to the present invention, the introduction of the electrons into the metal surface oxide is improved and the dissolution of the metal surface oxide is accelerated. The metal surface oxide can be removed rapidly even by the use of a substantially neutral deterging liquid having only weak corroding properties and hardly damaging the metallic substance to be deterged.

The process of the present invention is, therefore, effective for removing metal oxides formed on inner surfaces of apparatuses and piping in thermoelectric power plants, nuclear power plants and chemical plants and particularly for preventing an increase of radiation dose rate in nuclear power plants.

The inventors have found that when a metal piece is immersed in a deterging liquid in the presence of gaseous hydrogen and the piece is electrically connected with a stainless steel (metal to be deterged) coated with a metal surface oxide, electrons are introduced easily into the metal piece to remarkably increase the dissolution rate of the metal surface oxide.

The most suitable metal pieces are pieces of metals on the surface of which the reaction: $H_2 \rightarrow 2H^+ + 2e^-$ proceeds easily, such as those having a low hydrogen overvoltage such as platinum and palladium. Further, other metals such as nickel, copper, stainless steel and iron are also suitable.

In addition to the above-mentioned metals, carbon pieces which are electroconductive and on which surface the reaction: $H_2 \rightarrow 2H^+ + 2e^-$ proceeds may also be used. Further, substances having not so low hydrogen over-voltages, such as carbon and stainless steel, may be used after being coated with platinum or palladium by plating.

The simplest method of electrically connecting the metal or carbon piece with the metallic substance to be deterged comprises connecting them by means of an electric lead. Another method comprises pressing the metal piece or carbon piece to the metallic substance, taking advantage of an elasticity of said piece. Still another method comprises contacting the metal piece or carbon piece having a sufficient weight with the metallic substance, taking advantage of its weight. In this case, the pressure per unit area of the contacted surface is increased and the contact state is further improved when the metal piece or carbon piece having projections is used.

The easiest method of introducing hydrogen into the deterging liquid comprises blowing gaseous hydrogen therein. Alternatively, the deterging liquid containing hydrogen can be obtained by subjecting the liquid to a cathode electrolysis in an electrolytic cell. Namely, hydrogen is formed at the cathode by the electrolysis of water.

It is important in this method to prevent the incorporation of oxygen formed at the anode into the deterging liquid, since when oxygen is incorporated in the deterging liquid, the electrons introduced into the metal surface oxide are used for the reduction of oxygen and, therefore, the dissolution rate of the metal surface oxide cannot be increased. This phenomenon can be prevented by immersing the cathode in the deterging liquid, separating the anode therefrom by means of an ion-conductive diaphragm, preferably a cation exchange membrane, and charging an acid solution therein to form an electrolytic cell.

Further, it is desirable to remove oxygen from the deterging liquid as far as possible, since the presence of oxygen in the deterging liquid is not preferred for the above-mentioned reasons. Oxygen may be removed by preventing the invasion of oxygen extrained with blown gaseous hydrogen from outside and also by blowing an excess amount of hydrogen to expel oxygen from the system together with hydrogen. As a matter of course, it is also effective to heat or to boil the deterging liquid.

A preferred deterging liquid is a weakly corrosive, substantially neutral liquid having a pH of 5 to 7 and containing a complexing agent such as EDTA (ethylenediamine tetraacetic) or citrate of ammonium or sodium. A deterging liquid containing an acid, complexing agent and/or reducing agent is also effective.

DETAILED DESCRIPTION OF PREFERRED EMBODIMENTS

EXAMPLE 1

Figure 1:
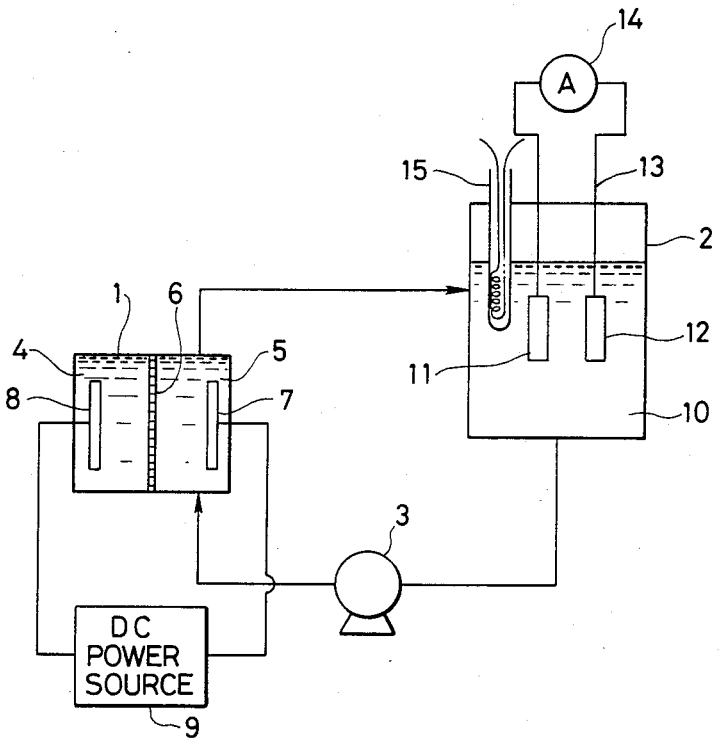
FIG. 1 is a diagram of a device used in the following examples of the present invention.

A sintered magnetite ($Fe_3O_4$) pellet was used as a test piece. The test piece was connected with a metal piece or carbon piece by means of an electric lead and immersed in a deterging liquid containing gaseous hydrogen obtained by the electrolysis. An electric current between the magnetite pellet and the metal piece or carbon piece (stream of the electrons introduced into the magnetite) was measured and, in addition, the amount of iron ion dissolved from the magnetite was also measured.

FIG. 1 is a diagram of a device used. The device comprises an electrolytic cell 1, a dissolution cell 2 and a pump 3. The electrolytic cell 1 comprises an anodic chamber 4 and a cathodic chamber 5 which are separated from each other by a cation exchange membrane 6. An electric current from a direct current source 9 flows between a cathode 7 and an anode 8 in the electrolytic cell 1 to generate hydrogen by the electrolysis at the cathode 7. A deterging liquid 10 containing hydrogen is sent from the cathodic chamber 5 into the dissolution cell 2 by means of the pump 3.

The magnetite pellet 11 and the metal piece or carbon piece 15 are charged in the dissolution tank 2. They are connected each with an electric lead 13 and an electric current which flows when the electric leads 13 are connected with each other is measured by means of an ampere meter 14. The device is provided with a heater 12 for keeping the deterging liquid at a given temperature.

The deterging liquid used was prepared by adjusting a pH value of an aqueous solution of 0.06% of EDTA-$2NH_4$ and 0.04% of ammonium citrate to 6 with ammonia. The temperature of the deterging liquid was 65° C. The area of the metal surface oxide layer on the magnetite pellet 11 was 5 $cm^2$ and the exposed area of the metal piece or carbon piece 12 to be contacted with the deterging liquid was also 5 $cm^2$. The other part (not covered by the layer) was sealed with a sealing material. The metal piece 12 was made of platinum, palladium, nickel, steel, stainless steel or iron.

The electric current flowing between the magnetite pellet 11 and the metal piece or carbon piece 12 and the amount of iron ion dissolved from the magnetite pellet 11 measured after 4 h are shown for each material in Table 1. Particularly when platinum or palladium having a low hydrogen overvoltage was used, the increase of the amount of dissolved iron ion was larger than that obtained when no metal piece was used.

When another metal piece or carbon piece was used, the amount of the iron ion dissolved from the magnetite was increased, though the increase was not so remarkable as that obtained by using platinum or palladium. A reason why the capacity of iron was as high as that of palladium is that iron was slightly corroded by the liquid even though the liquid was neutral and, therefore, electrons were released to contribute the result so much.

TABLE 1

| Metal piece or carbon piece | Electric current (mA) | Amount of iron ion dissolved (mg) |
|---|---|---|
| Not used | — | 0.2 |
| Platinum | 0.5–0.8 | 7.6 |
| Palladium | 0.3–0.7 | 6.2 |
| Nickel | 0.2–0.4 | 3.5 |
| Copper | 0.2–0.4 | 3.2 |
| Iron | 0.5–0.6 | 6.0 |
| Stainless steel | 0.01–0.1 | 0.5 |
| Carbon | 0.2–0.3 | 2.5 |

EXAMPLE 2

The same combinations of the magnetite pellet and the metal piece and the same deterging liquid as in Example 1 were employed, except that gaseous hydrogen was blown into the deterging liquid instead of generating hydrogen by electrolysis to measure the electric current flowing between the magnetite pellet and the metal piece and the amount of the iron ion dissolved from the magnetite pellets were measured.

The device used was only the dissolution cell 2 in the device shown in FIG. 1. The capacity was inferior to that obtained in Example 1 wherein hydrogen was introduced into the deterging liquid by electrolysis under given temperature conditions. The amount of the electric current and that of iron ion dissolved from the magnetite were as small as 1/5 to $\frac{5}{8}$-fold of those of Example 1. When the temperature was elevated to 85° C., the reaction was accelerated and the dissolution was increased to a degree equal to or $\frac{1}{2}$-fold of that obtained in Example 1.

EXAMPLE 3

A test piece taken from a stainless steel pipe in a nuclear power plant the inner surface of which pipe was covered by a metal surface oxide containing a radioactive nuclide mainly comprising $^{60}Co$ was used. The metal surface oxide was dissolved to remove the radioactivity.

The same device as in Example 1 was used. Hydrogen was introduced into the deterging liquid by electrolysis. The deterging liquid used was prepared by ajusting the pH value of an aqueous solution of 0.06% of EDTA-$2NH_4$, 0.04% of diammonium citrate and 0.05% L-ascorbic acid to 6 with ammonia. The temperature of the liquid was 80° C.

The area of the metal surface oxide layer on the test piece was 2.25 $cm^2$. The exposed areas of the metal surface such as cut areas were sealed with a sealing material. A metal piece to be contacted with the test piece had an exposed area of 2 $cm^2$. The amounts of $^{60}Co$ before and after the deterging were measured to determine the removal rate of $^{60}Co$.

The removal rate of $^{60}Co$ after deterging for 16 h are shown in Table 2. It is apparent from Table 2 that the removal rate of $^{60}Co$ was increased remarkably by the contact with the metal piece as compared with that obtained in the absence of any metal piece.

TABLE 2

| Metal piece | $^{60}Co$ removal rate (%) |
|---|---|
| Not used | 25 |
| Platinum | 86 |
| Nickel | 60 |
| Stainless steel | 50 |

TABLE 2-continued

| Metal piece | $^{60}Co$ removal rate (%) |
|---|---|
| Iron | 82 |

EXAMPLE 4

In this example, the process of the present invention was employed practically. In an embodiment of the process, a stainless steel pipe in a nuclear power plant was used as the metal substance to be deterged. A metal surface oxide formed on the inner surface of the metal substance contained a radioactive ion $^{60}Co$ incorporated therein from a cooling water flowing in the plant.

A stainless steel plate plated with platinum was inserted as deeply as possible into the pipe having the metal surface oxide layer. The metal piece was connected with the pipe by means of an electric lead. Then, a deterging liquid containing hydrogen obtained by electrolysis was introduced therein. The deterging liquid was the same as that used in Example 3.

By this treatment, the metal surface oxide was removed from the pipe by the dissolution and, therefore, the radioactivity contained in the metal surface oxide was also removed.

We claim:

1. A process for removing a metal surface oxide layer from a metallic substance by contacting the metal surface oxide layer with a gaseous hydrogen containing deterging liquid to introduce electrons into the metal surface oxide in contact with the deterging liquid and to dissolve the metal surface oxide, wherein the metal surface oxide layer is composed mainly of an iron oxide, the electrons are formed on the metal surface oxide layer, and the deterging liquid contains at least one of an organic acid, an organic salt or an organic complexing agent, and further wherein a metal piece selected from at least one of platinum, palladium, nickel, iron, copper and stainless steel or a carbon piece is immersed in the deterging liquid and the metal piece or the carbon piece is electrically connected with the metal surface oxide layer of the metallic substance.

2. A process for removing a metal surface oxide from a metallic substance according to claim 1, wherein the metal piece or the carbon piece has a platinum, palladium or nickel layer on the surface thereof.

3. A process for removing a metal surface oxide form a metallic substance according to claim 1, wherein the deterging liquid is a neutral or substantially neutral liquid.

4. A process for removing a metal surface oxide from a metallic substance according to claim 3, wherein the deterging liquid is a liquid having a pH of about 5 to 7 and containing at least one of ethylenediaminetetraacetate (EDTA), citrate of ammonium or citrate of sodium.

5. A process for removing a metal surface oxide layer from a stainless steel pipe by contacting the metal surface oxide layer with a deterging liquid containing gaseous hydrogen to introduce electrons into the metal surface oxide layer in contact with the deterging liquid and to dissolve the metal surface oxide, wherein the metal surface oxide layer is composed mainly of an iron oxide, the electrons are formed on the metal surface oxide layer, and the deterging liquid contains a complexing agent, and further wherein a stainless steel plate plated with one of platinum, palladium or nickel is immersed in the deterging liquid and the plated stainless steel plate is electrically connected to the metal surface oxide on the stainless steel pipe.

6. A process for removing a metal surface oxide layer from a metallic substance according to claim 1, wherein the oxide is a magnetite layer, the deterging liquid contains a complexing agent, and the metal piece or the carbon piece immersed in the deterging liquid is electrically connected with the magnetite layer of the metallic substance.

7. A process according to claim 1, wherein the metal piece or the carbon piece is electrically connected by at least one of an electric lead and physical contact.

8. A process according to claim 1, wherein the gaseous hydrogen is supplied by directly blowing into the deterging liquid or by subjecting the deterging liquid to cathode electrolysis in an electrolytic cell, said cell being provided with an ion-conductive diaphragm to prevent oxygen gas from accumulating in the deterging liquid.

9. A process according to claim 1, wherein gaseous oxygen is removed from the deterging liquid.

10. A process according to claim 1, wherein the deterging liquid is an aqueous solution of 0.06% of EDTA—$2NH_4$ and 0.04 of ammonium citrate, and the pH of the aqueous solution is adjusted to 6 with ammonium, the temperature of the deterging liquid being 65° C.

11. A process according to claim 1, wherein the deterging liquid is an aqueous solution of 0.06% of EDTA—$NH_4$, 0.04% of diammonium citrate, and 0.05% of L-ascorbic acid, and the pH of the aqueous solution is adjusted to 6 with ammonium, the temperature of the deterging liquid being 80° C.

* * * * *